US007334768B1

(12) United States Patent
Lum

(10) Patent No.: US 7,334,768 B1
(45) Date of Patent: Feb. 26, 2008

(54) COLLAPSIBLE MUSIC BOOK STAND

(76) Inventor: Samuel B. Y. Lum, 1337-C 7th Ave., Honolulu, HI (US) 96816-2670

( * ) Notice: Subject to any disclaimer, the term of this patent is extended or adjusted under 35 U.S.C. 154(b) by 204 days.

(21) Appl. No.: 11/156,899

(22) Filed: Jun. 20, 2005

(51) Int. Cl.
*A47B 97/04* (2006.01)

(52) U.S. Cl. ..... 248/444; 248/460

(58) Field of Classification Search ..... 248/444, 248/447, 460, 461, 462; 40/124.15, 124.14, 40/124.08; 281/33, 49
See application file for complete search history.

(56) References Cited

U.S. PATENT DOCUMENTS

| | | | | |
|---|---|---|---|---|
| 205,156 | A | 6/1878 | Turner | |
| 2,014,176 | A | 9/1935 | Henderson | |
| 2,726,835 | A | 12/1955 | Hummel | |
| 3,119,194 | A * | 1/1964 | Ray | 248/459 |
| 3,410,516 | A | 11/1968 | Criswell | |
| 3,460,795 | A * | 8/1969 | Dahlin | 248/452 |
| 4,460,146 | A * | 7/1984 | Raggiotti | 248/456 |
| 4,544,123 | A * | 10/1985 | Peacock | 248/460 |
| 4,607,817 | A | 8/1986 | Aquino | |
| 4,709,895 | A | 12/1987 | Mardak | |
| 5,114,111 | A | 5/1992 | Andrews | |
| 5,722,628 | A | 3/1998 | Menaged | |
| 6,045,108 | A * | 4/2000 | Cziraky | 248/454 |
| 6,270,049 | B1 | 8/2001 | Olvey | |
| 6,491,277 | B1 | 12/2002 | Chappell et al. | |
| 6,557,811 | B1 | 5/2003 | Burns | |

FOREIGN PATENT DOCUMENTS

| | | |
|---|---|---|
| FR | 2.659.539 | 9/1991 |
| GB | 2.148.703 | 6/1985 |
| JP | 5.154.018 | 9/1993 |
| JP | 9.023.932 | 1/1997 |

* cited by examiner

*Primary Examiner*—A. Joseph Wujciak, III
(74) *Attorney, Agent, or Firm*—Michael I Kroll

(57) ABSTRACT

Apparatus 10 discloses a collapsible desk top music book stand which includes hinged panels movable into an erect assembly with a pair of posts 36 and hole 38 forming releasable assembly securement. When in use, the music book stand 10 is positioned on a desk top at eye level vision and is easily portable. Additionally, the stand 10 has a front 13 and rear 15 side with the front side having opposing pivotal leafs 14, 16 increasing the article support area, which provide means to accommodate various size music books while limiting the consumption of desk space. The hinged panels include non-slip pads 30, 32 at each end to provide both improved stability of the stand and protection of the desktop surface. The construction of the music stand 10 may include separate hinges that are bolted or riveted to each panel or may include preformed hinges that are integral 40 to the panels.

11 Claims, 12 Drawing Sheets

COLLAPSIBLE MUSIC BOOK STAND

BACKGROUND OF THE INVENTION

1. Field of the Invention

The present invention relates generally to music stands and, more specifically, to a collapsible desk top music book stand.

The collapsible desk top music book stand of the present invention includes hinged panels movable into an erect assembly with a post and hole forming releasable assembly securement. When in use, the music book stand is positioned on a desk top at eye level vision and is easily portable.

Additionally, the said stand has a front and rear side with the front side having opposing pivotal leafs increasing the article support area. In turn the music book stand provides means to accommodate various size music books while limiting the consumption of desk space.

The hinged panels include non-slip pads at each end to provide both improved stability of the stand and protection of the desktop surface.

The construction of the present invention may include separate hinges that are bolted or riveted to each panel or may include preformed hinges that are integral to the panel.

2. Description of the Prior Art

There are other music book stands. Typical of these is U.S. Pat. No. 205,156 issued to Josiah S. Turner on Jun. 18, 1878.

Another patent was issued to O. G. Henderson on Mar. 30, 1934 as U.S. Pat. No. 2,014,176. Yet another U.S. Pat. No. 2.726.835 was issued to R. S. Hummel on Dec. 13, 1955 and still yet another was issued on Nov. 12, 1968 to M. L. Criswell as U.S. Pat. No. 3,410,516.

Another patent was issued to Peter Peacock on Oct. 1, 1985 as U.S. Pat. No. 4,544,123. Yet another U.S. Pat. No. 4,607,817 was issued to Salvatore A. Aquino on Aug. 26, 1986. Another was issued to Keith Mardak on Dec. 1, 1987 as U.S. Pat. No. 4,709,895 and still yet another was issued on May 19, 1992 to Kim N. Andrews as U.S. Pat. No. 5,114,111.

Another patent was issued to David L. Menaged on Mar. 3, 1998 as U.S. Pat. No. 5,722,628. Yet another patent was issued to Douglas A. Olvey on Aug. 7, 2001 as U.S. Pat. No. 6,270,049. Another patent was issued to Perry W. Chappell on Dec. 10, 2002 as U.S. Pat. No. 6,491,277. Yet another U.S. Pat. No. 6,557,811 was issued to Daniel Burns on May 6, 2003.

Internationally, a patent was issued to Robert Ogilvie Baxter on Jun. 5, 1995 as United Kingdom. Patent No. GB2148703 and still another was issued on Sep. 20, 1991 to Sylvain Jacques Klein as France. Patent No FR2,659,539. Another patent was issued to Yoshio Fujii on Jun. 22, 1993 as Japan Patent No. JP5,154,018. Yet another Japanese patent was issued to Masayuki Inami on Jan. 28, 1997 as patent number JP9,023,932

U.S. Pat. No. 205,156

Inventor: Josiah S. Turner

Issued: Jun. 18, 1878

This invention has for its object the production of an improved portable book rest or support for holding a book up and open at any desired page. The novelty consists in the inserted construction of the device, as will be herewith set forth and specifically claimed.

U.S. Pat. No. 2,014,176

Inventor: O. G. Henderson

Issued: Mar. 30, 1934

This invention relates generally to-book rests, and; particularly to adjustable supports which permit a book, paper or other reading matter to be held securely and properly and at the desired angle and height for proper reading. A further object of the invention is to provide a book holder combined with means for the accommodation of—pencils, pens; crayons, books and other such material as may be utilized in writing, reading drawing, etc. the device being so constructed as to properly house and retain such materials securely when the stand is either in setup or in collapsed positions.

U.S. Pat. No. 2,726,835

Inventor: R. S. Hummel

Issued: Dec. 13, 1955

The present invention relates to collapsible display stands for supporting and exhibiting articles of merchandise and the like. A principal object of the invention is to produce an inexpensive stand of the character indicated which may be made of a single sheet of relatively stiff but thin material such as suitable cardboard stock blanked out by dies or otherwise, which is well adapted to be supplied in flat form by manufacturers and distributors and to be set up in operative position by retailers for the purpose of displaying merchandise on store counters, shelves, show cases, etc.

U.S. Pat. No. 3,410,516

Inventor: M. L. Criswell

Issued: Nov. 12, 1968

The bookrest is provided by a single elongated piece of pliable sheet material with lateral crease lines or portions of flat stiff sheet material hinged by tapes and can be laid flat for shipping or the like and readily folded providing an upright support for a book at a proper angle for reading.

U.S. Pat. No. 4,544,123

Inventor: Peter Peacock

Issued: Oct. 1, 1985

A foldable easel for supporting sheet material includes three sheet members pivoted end to end for selective movement between a folded condition with the members in stacked parallel relation and an erected condition with the members in triangular relation. The free end of one of the two outer members has a lip for supporting the sheet material to rest against the upstanding sheet member in the erected condition. In one embodiment, a mating pin-and-hole connecting system is provided at the free ends of the outer members and at the ends of the intermediate member for permitting releasable connection of the members in either their erected or folded conditions. In another embodiment, one of the outer members has a perimetric border within which the other members are contained in the folded condition and which acts as the lip for engagement therewith of the other outer sheet member when in the erected condition. The outer sheet member which is upstanding in the erected condition may be provided with pivoted side portions for expanding the available surface area for use as a photographic slide projection screen or for additional sheet material support. Holes are provided along the side of at least one of the sheet members for receipt of the easel in a ringed binder.

U.S. Pat. No. 4,607,817

Inventor: Salvaotre A. Aquino

Issued: Aug. 26, 1986

A collapsible podium comprising a front panel, a rear panel, and a flat floor panel all in hinged relationship to each other essentially along respective adjacent edges. The floor panel has a rear portion and a front portion in hinged relationship to each other. Disposed along essentially the lower edge of the front panel is a lip projecting forwardly at essentially a right angle with said front panel and at an upward angle from a horizontal plane. The podium collapses and folds along the several hinged relationships, and can have releasable securement means which maintains the podium in a folded configuration.

U.S. Pat. No. 4,709,895

Inventor: Keith Mardak

Issued: Dec. 1, 1987

A portable collapsible apparatus for supporting material such as sheet music to be viewed by an individual without the need for the viewing individual to support the article by hand. The apparatus includes a plurality of pivotally connected rigid members which are pivotable about a plurality of parallel spaced apart axes. The material extends from a forward edge to a free edge with a transverse stop provided at the forward edge. The rigid members are sized such that the free edge is pivotable to a position opposing the stop with a support surface projecting away from the stop at an inclined angle to support the article to be viewed.

U.S. Pat. No. 5,114,111

Inventor: Kim N. Andrews

Issued: May 19, 1992

A collapsible music stand composed of a plurality of foldable panels which are mounted on a tripod base. Sheet music is to be located against the foldable panels. Foldable panels include a center panel with one side panel mounted to the right edge of the center panel and another side panel mounted to the left edge of the center panel. The side panels have bottom edges which are slightly misaligned from the bottom edge of the center panel so that the side panels can be pivoted to rest against the front side of the center panel with the bottom edges of the side panels not interfering with the lower edge of the center panel. The side panels are capable of assuming a substantially aligned position with the center panel with the side panels being slightly inclined so that relative to the front side of the center panel there is formed a slightly concave configuration. Pivotal shelf members are mounted to the bottom edges of the side panel and to the lower edge of the center panel.

U.S. Pat. No. 5,722,628

Inventor: David L. Menaged

Issued: Mar. 3, 1998

A portable, collapsible reading stand for supporting a book, magazine or other sheet reading materials includes a blank of substantially rigid material having adjacently positioned panels hingedly movable relative to one another and including a base panel, a first panel group and a second panel group. The first panel group is structured for upward and rearward sloping of a frontal panel thereof throughout a range of angular, adjusted positions relative to the base panel. The second group of panels is structured to provide a support lip adjacent a lower portion of the frontal panel, the support lip being movable through a range of angular adjusted positions relative to the frontal panel so as to support a bottom edge of the reading materials. At least one of the panels accommodates a tape flag dispenser housing for providing tape flags in order to mark pages of the reading material.

U.S. Pat. No. 6,270,049

Inventor: Douglas A. Olvey

Issued: Aug. 7, 2001

An easel or book stand for the support of a book or booklet utilizing front and rear panels movable into a spread-apart relationship. An elongate base member attached between the lower edges of the panels includes a first flexible elongate component hingedly connected along the lower edge of the front panel as well as to a second elongate component. The second elongate component has a slightly greater width than the first elongate component, and through an intermediate base member, has a connection with the lower edge of the rear panel. The front panel, when its lower edge is moved a bit rearwardly from its spread-apart relationship with the rear panel, causes the first and second elongate components to move into an adjacent, substantially coplanar relationship. The first and second elongate components are together rotatable between an outwardly-extending, book-receiving position along the lower edge of the front panel, and an upward position in which the elongate components are in essential parallelism with the front panel. The first elongate component, being of lesser width than the second elongate component, serves as some support for the lower edge of the front panel during such upward rotation of the elongate components, with the portion of the weight of the front panel borne by the first elongate component contributing to the development of an automatic bias holding the second elongate component in firm contact with the lower edge of a book residing adjacent the front panel.

U.S. Pat. No. 6,491,277

Inventor: Perry W. Chappell

Issued: Dec. 10, 2002

A music holding device for a piano for protecting a piano and providing a support for music sheets and books. The music holding device for a piano includes a holder member including a folded-over panel member having a back portion and a front portion having a top edge which is integrally attached along a top edge of the back portion with the holder member being adapted to stand upon a surface of a piano with the front portion being adapted to support sheets and books of music.

U.S. Pat. No. 6,557,811

Inventor: Daniel Burns

Issued: May 6, 2003

A triangular-shaped portable collapsible stand to accommodate either sheet music or books. It is a three-piece stand is designed for table top use. It is assembled by sliding angled slots into grooves.

U.K. Patent Number GB2148703

Inventor: Robert Ogilvie Baxter.

Issued: Jun. 5, 1995

A vehicle desk unit comprises a base with hinged support members at both ends foldable under the base. A document presentation board is hinged to one side edge of the base and is foldable over the base. To the other side edge is hinged a strut foldable over the base and releasably connectable to the board along their unhinged edges by meshing plastics strips or press studs. A spring-held document clip is attached to the board. Two eyelets are secured to the base under the sides thereof to provide attachment points for the hooked ends of a resilient strap. In use, one of the support members is folded down to project from the base, and the bottom edge rests upon the rear end of a vehicle seat cushion, whose front end is higher and supports the other end of the base. One hooked end of the strap is disengaged from its eyelet and passed around the back of the seat and re-engaged with its eyelet, so that the strap is stretched and holds the end of the base against the seat back.

France Patent Number FR2,659,539

Inventor: Sylvain Jacques Klein

Issued: Sep. 20, 1991

The invention relates to a single piece bookrest intended to hold a book in an inclined position in order to allow easier reading or copying-out. It consists of two rigid walls and joined by a fold, and two flexible lateral faces folded into an accordion and limiting the separation of these walls. The base of the wall is folded into a triangle dimensioned such as to obtain a rigid base providing good seating for the book resting against this wall. An increased thickness on the end of the base prevents this triangular part from unfolding. Simple folding makes it possible to convert it into a document holder, the base of which acts as a flap. It is held closed by self-gripping fasteners. Use according to the invention is particularly designed for young scholars and typists.

Japan Patent Number JP5,154,018

Inventor: Yoshio Fujii

Issued: Jun. 22, 1993

A back panel of a book rest main body is bent upward along a fold and a support panel is bent upward along a fold. The angle of the back panel is selected, and a protruding part at the tip is connected to one of stopper holes to fix the back panel. A document is leaned against the back panel on the tilt when a user reads a book. Page holders are inserted into groove holes to flexibly hold a page by bent tips. To slow or package the book rest, the protruding part is pulled off from the stopper hole and the support panel and the back panel are folded into the original shape. The main body can be kept within the total thickness of two panels. The page holders are pulled out so as to bring incisions outside, and bent down toward the book rest main body to make the entire height of the book rest low.

Japan Patent Number JP9,023,932

Inventor: Masayuki Inami

Issued: Jan. 28, 1997

The two plates whose movable parts are bendable and expandable are manufactured by the molded item of polypropylene and a plastic sheet or the like and fixed by the part of an eyelet and a rivet or the like. Also, a rail part is provided on one of the plates, a rivet-like holding tool is attached to the other plate and the two plates are mutually slid back and forth. Then, the projections are provided on the upper surface of a lower plate end part, the several holes are provided on the upper plate end part, the upper plate end part is slightly raised, the holes are detached from the projections and the inclination of the bookrest is adjusted by moving them back and forth. Thus, the upper and lower plates keep the state of being slid while being in contact with each other.

While these music and book holding devices may be suitable for the purposes for which they were designed, they would not be as suitable for the purposes of the present invention, as hereinafter described.

SUMMARY OF THE PRESENT INVENTION

The present invention discloses a collapsible desk top music book stand, which includes hinged panels movable into an erect assembly with a pair of posts and hole forming releasable assembly securement. When in use, the music book stand is positioned on a desk top at eye level vision and is easily portable. Additionally, the stand has a front and rear side with the front side having opposing pivotal leafs increasing the article support area which provide means to accommodate various size music books while limiting the consumption of desk space. The hinged panels include non-slip pads at each end to provide both improved stability of the stand and protection of the desktop surface. The construction of the present invention may include separate hinges that are bolted or riveted to each panel or may include preformed hinges that are integral to the panels.

A primary object of the present invention is to provide a desktop collapsible book stand.

Another object of the present invention is to provide a desktop collapsible book stand with hinged panels movable into an erect assembly.

Yet another object of the present invention is to provide a desktop collapsible book stand with a post and hole forming releasable assembly securement.

Another object of the present invention is to provide a desktop collapsible book stand where the said stand has a front and rear side with the front side having opposing pivotal leafs increasing the article support area.

Still yet another object of the present invention is to provide a desktop collapsible book stand that provides means for eye level vision of the music book while in use.

Another object of the present invention is to provide a desktop collapsible book stand that is portable.

Yet another object of the present invention is to provide a desktop collapsible book stand that includes no-slip pads on each panel.

Still yet another object of the present invention is to provide a desktop collapsible book stand that is constructed with bolted, riveted, or integral hinges.

Additional objects of the present invention will appear as the description proceeds.

The present invention overcomes the shortcomings of the prior art by providing a collapsible desk top music book stand that includes hinged panels movable into an erect assembly with a post and hole forming releasable assembly securement. As well as the said stand having a front and rear side with the front side having opposing pivotal leafs increasing the article support area.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
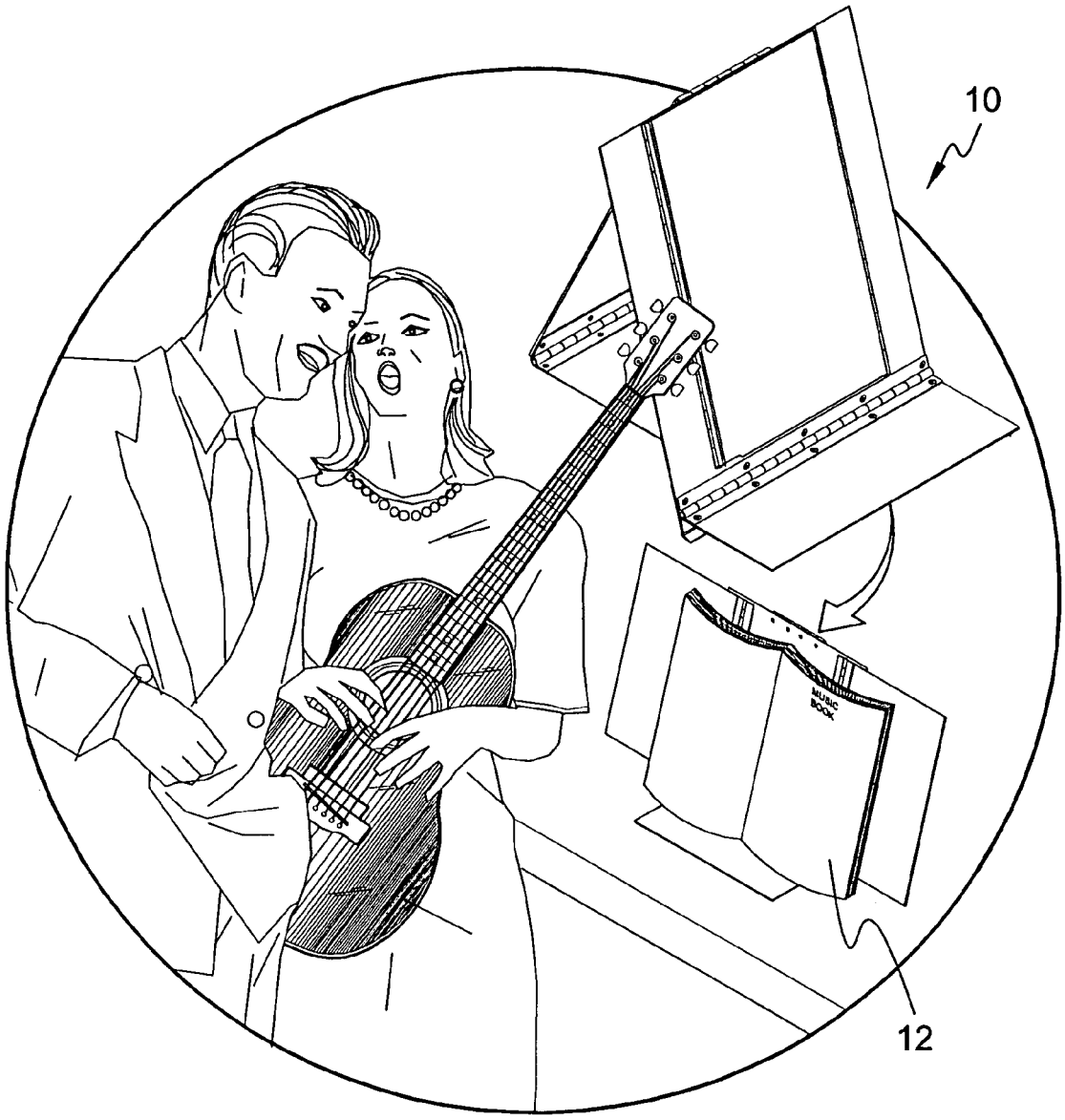
FIG. 1 is an illustrative view of the present invention in use.

With regard to reference numerals used, the following numbering is used throughout the drawings.

10 present invention
11 planar member
12 music book
13 front surface
14 extension leaf
15 rear surface
16 extension leaf
18 hinge
20 hinge
22 hinge
24 hinge
26 lower pivotal leaf
28 hinge
30 non-slip pad
32 non-slip pad
34 support leaf
35 support leaf
36 front and rear securing post
38 securing post apertures
40 integral hinge
42 hinge pin
44 direction arrow
46 flange

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a collapsible desk top music book 12 stand having hinged parts movable into an erect assembly with a post and hole forming releasable assembly securement. The stand 10 has a front and rear side with the front side having opposing pivotal leafs increasing the article support area.

Figure 2:
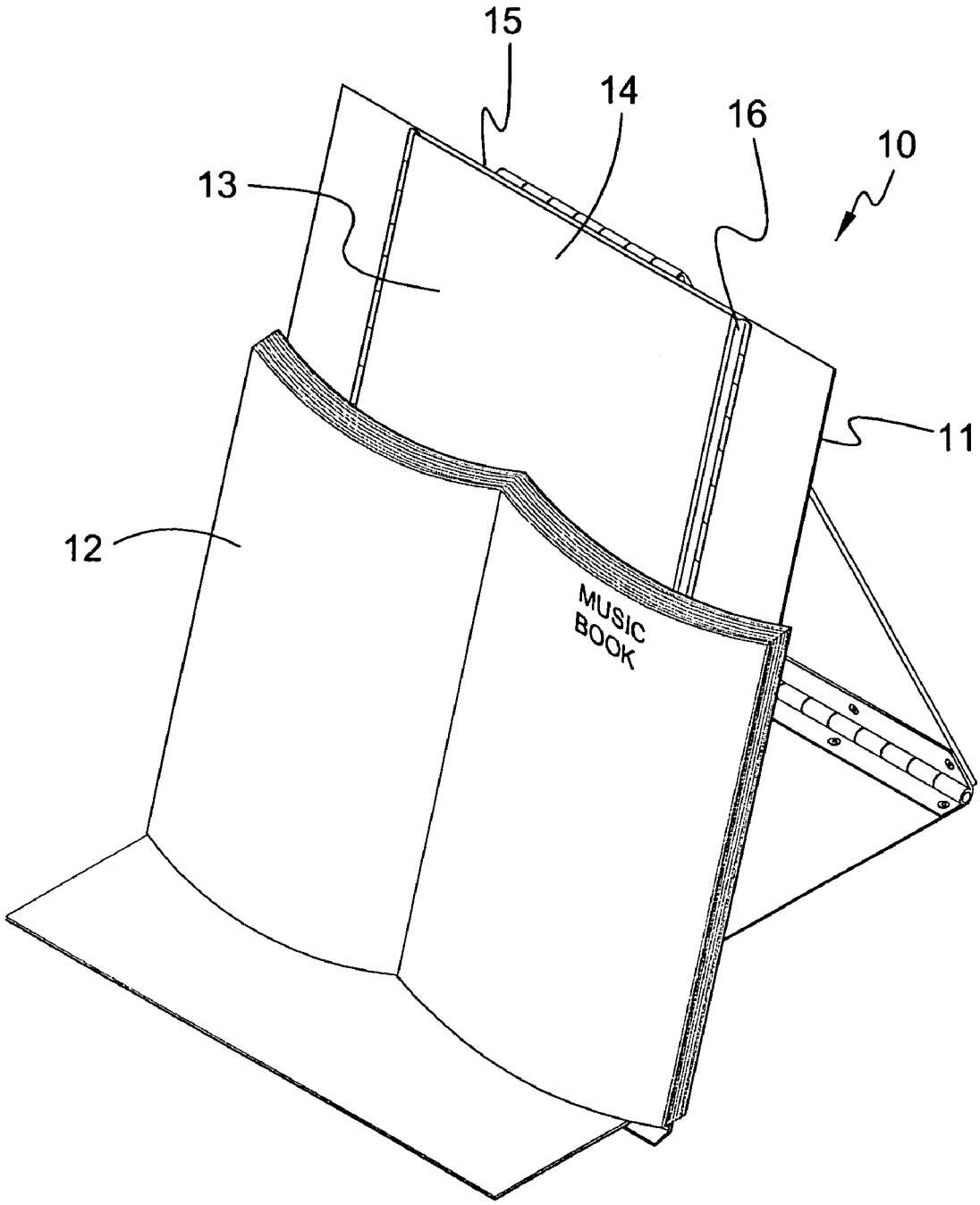
FIG. 2 is a perspective view of the present invention having a book positioned thereon.

Turning to FIG. 2, shown therein is a perspective view of the present invention 10 having a book 12 positioned thereon. Shown is the present invention 10 disclosing a collapsible desk top music book stand having hinged parts movable into an erect assembly with a post and hole forming releasable assembly securement. The stand 10 has a planar member 11 having front 13 and rear 15 surfaces with the front side having opposing pivotal leafs 14, 16 folded inwardly for increasing the article support area. The device 10 is positioned on a desk top at eye level vision and is easily portable.

Figure 3:
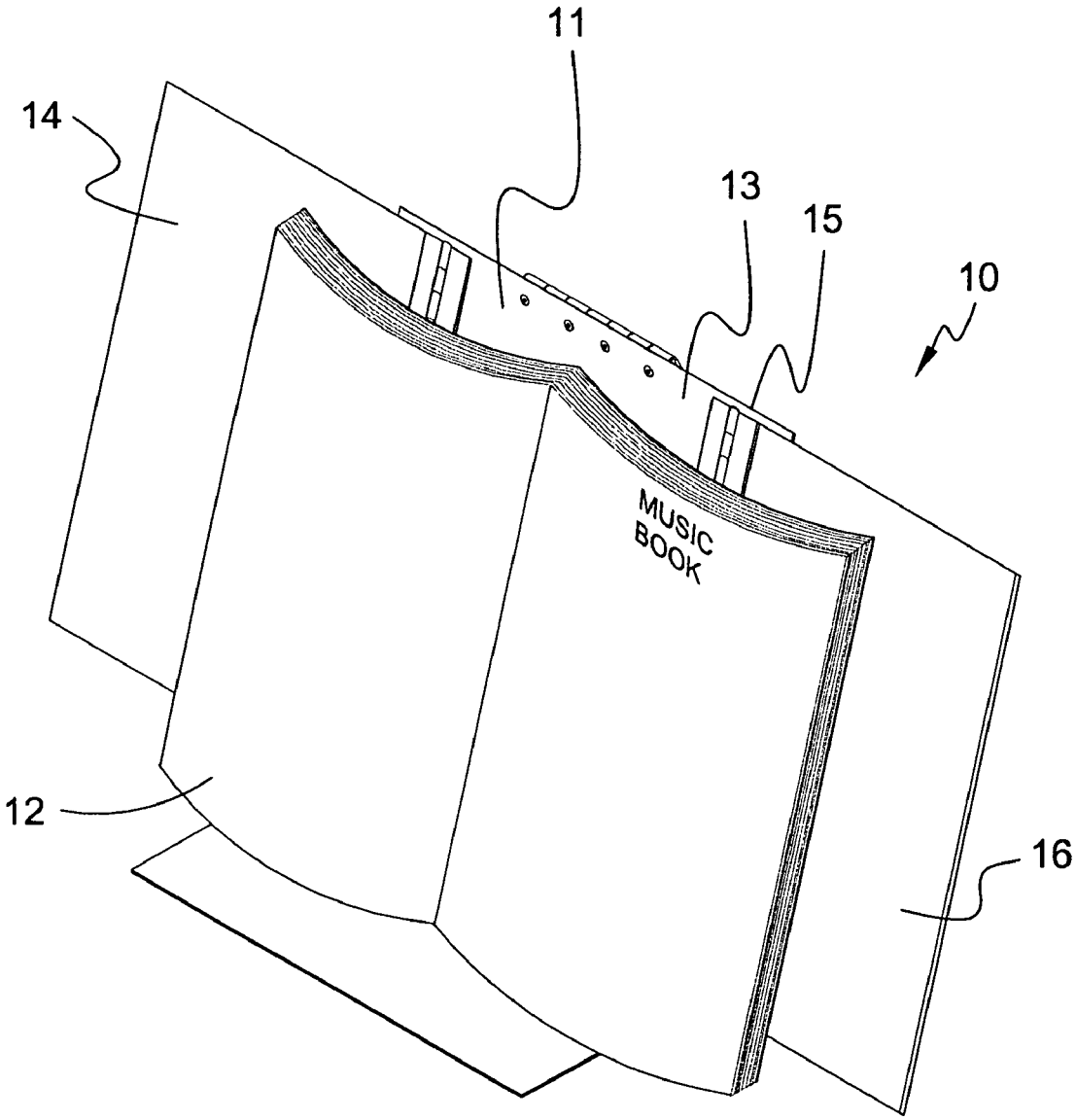
FIG. 3 is a perspective view of the present invention having a book positioned thereon and in an extended position to accommodate larger books.

Turning to FIG. 3, shown therein is a perspective view of the present invention 10 having a book 12 positioned thereon and in an extended position to accommodate larger books. Shown is the present invention 10 disclosing a collapsible desk top music book stand having hinged parts movable into an erect assembly with a post and hole forming releasable assembly securement. The stand has a planar member 11 which has a front 13 and rear 15 side with the front side having opposing pivotal leafs 14, 16 folded outwardly for increasing the article support area. The device 10 is positioned on a desk top at eye level vision and is easily portable.

Figure 4:
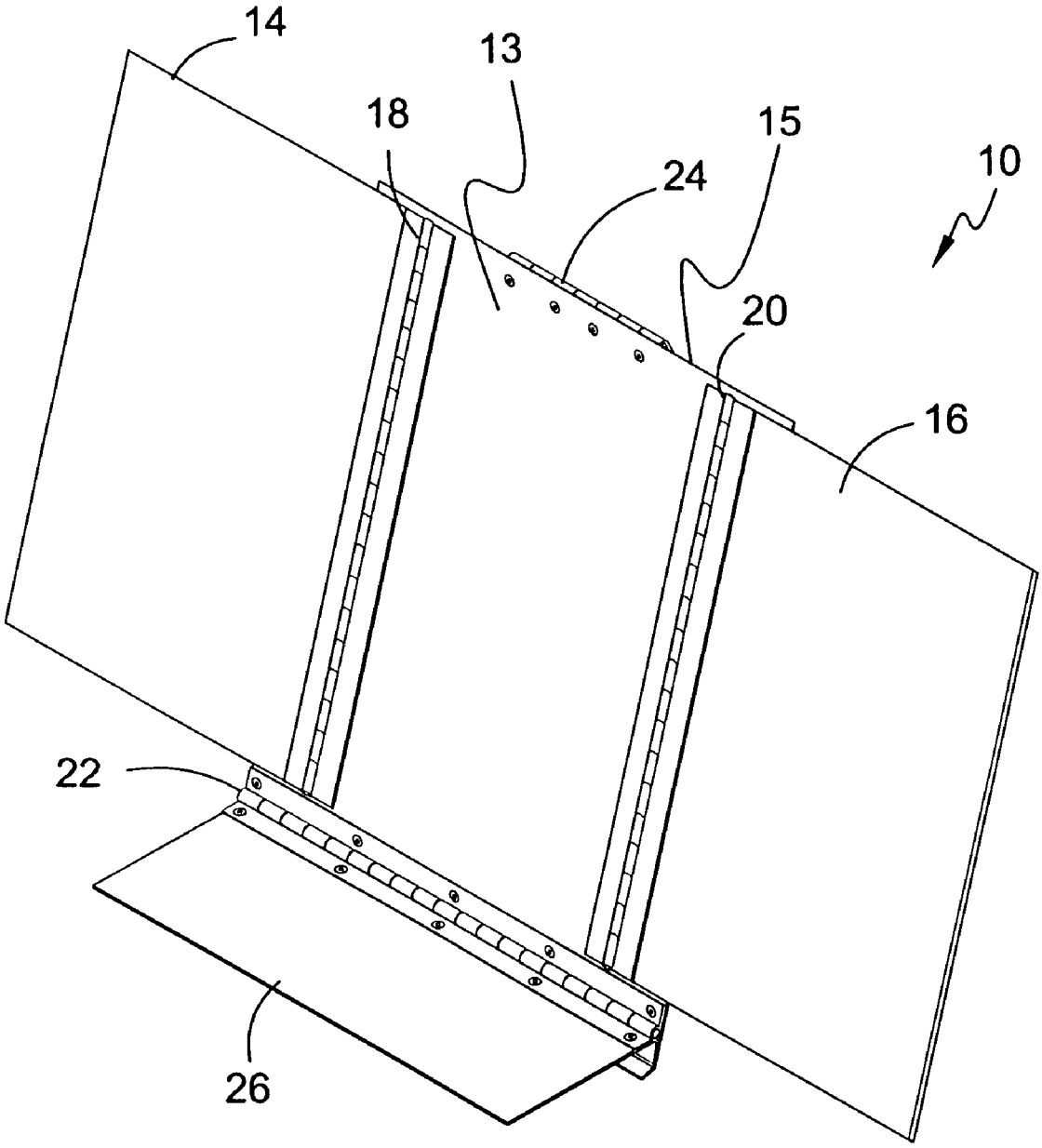
FIG. 4 is a perspective view of the present invention in an extended position to accommodate larger books.

Turning to FIG. 4, shown therein is a perspective view of the present invention 10 in an extended position to accommodate larger books. Shown is the present invention 10 disclosing a collapsible desk top music book stand having hinged parts movable into an erect assembly with a post and hole forming releasable assembly securement. The stand 10 has a planar member 111 which has a front 13 and rear 15 side with the front side having opposing pivotal leafs 14, 16 folded outwardly for increasing the article support area. The device 10 is positioned on a desk top at eye level vision and is easily portable. Also shown are hinges 18, 20, 22, and 24 along with lower pivotal leaf 26 which is also folded away from front side 13.

Figure 5:
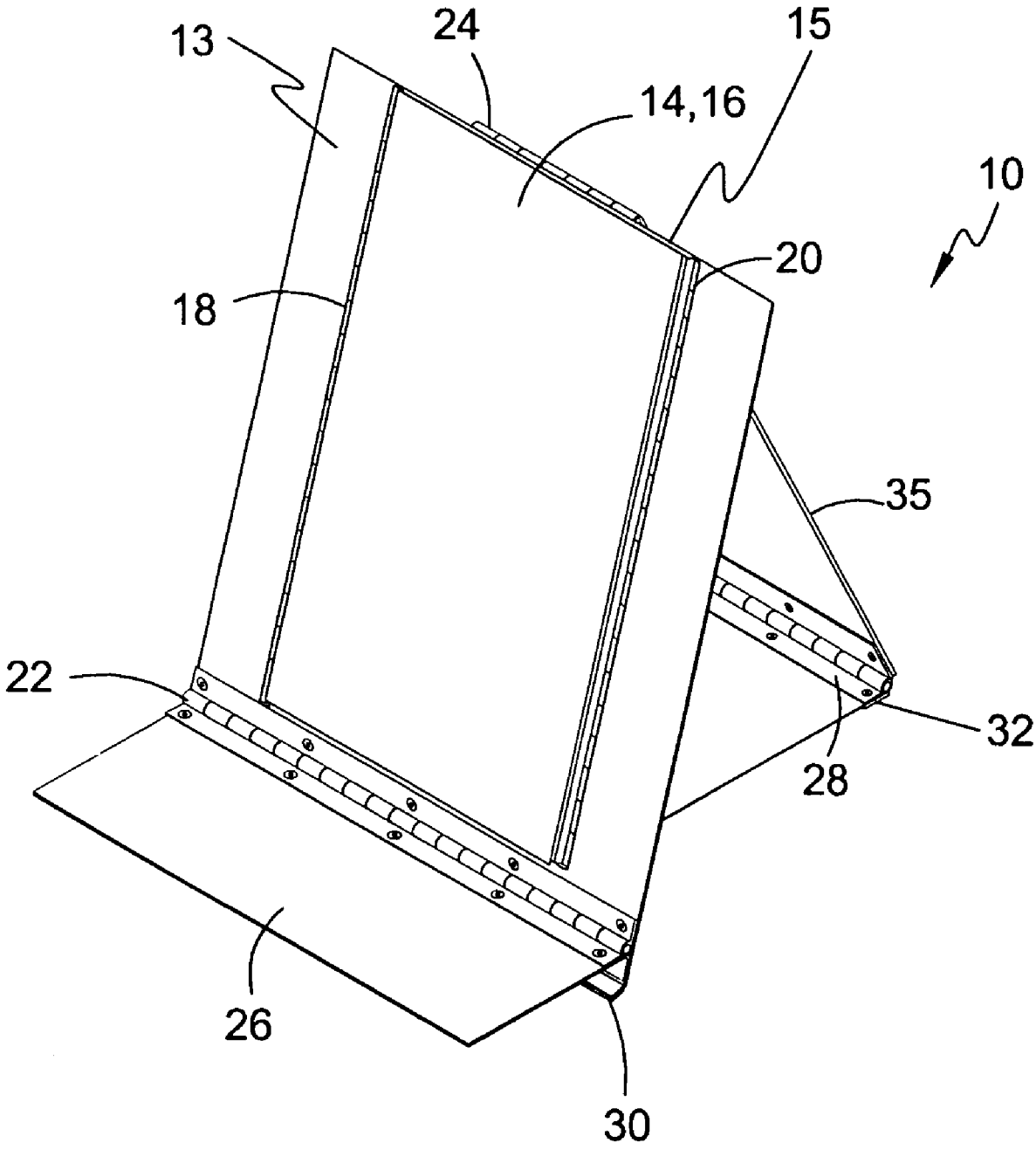
FIG. 5 is a perspective view of the present invention in a normally open position.

Turning to FIG. 5, shown therein is a perspective view of the present invention 10 in a normally open position. Shown is the present invention 10 disclosing a collapsible desk top music book stand having hinged parts movable into an erect assembly with a post and hole forming releasable assembly securement. The stand 10 has a planar member 11 which has a front 13 and rear 15 side with the front side having another pair of planar members providing opposing pivotal leafs 14, 16 folded inwardly for increasing the article support area. The device 10 is positioned on a desk top at eye level vision and is easily portable. Shown are hinges 18, 20, 22, 24 and 28, lower pivotal leaf 26, non-slip pads, 30, 32, and another planar member providing a rear support leaf 35.

Figure 6:
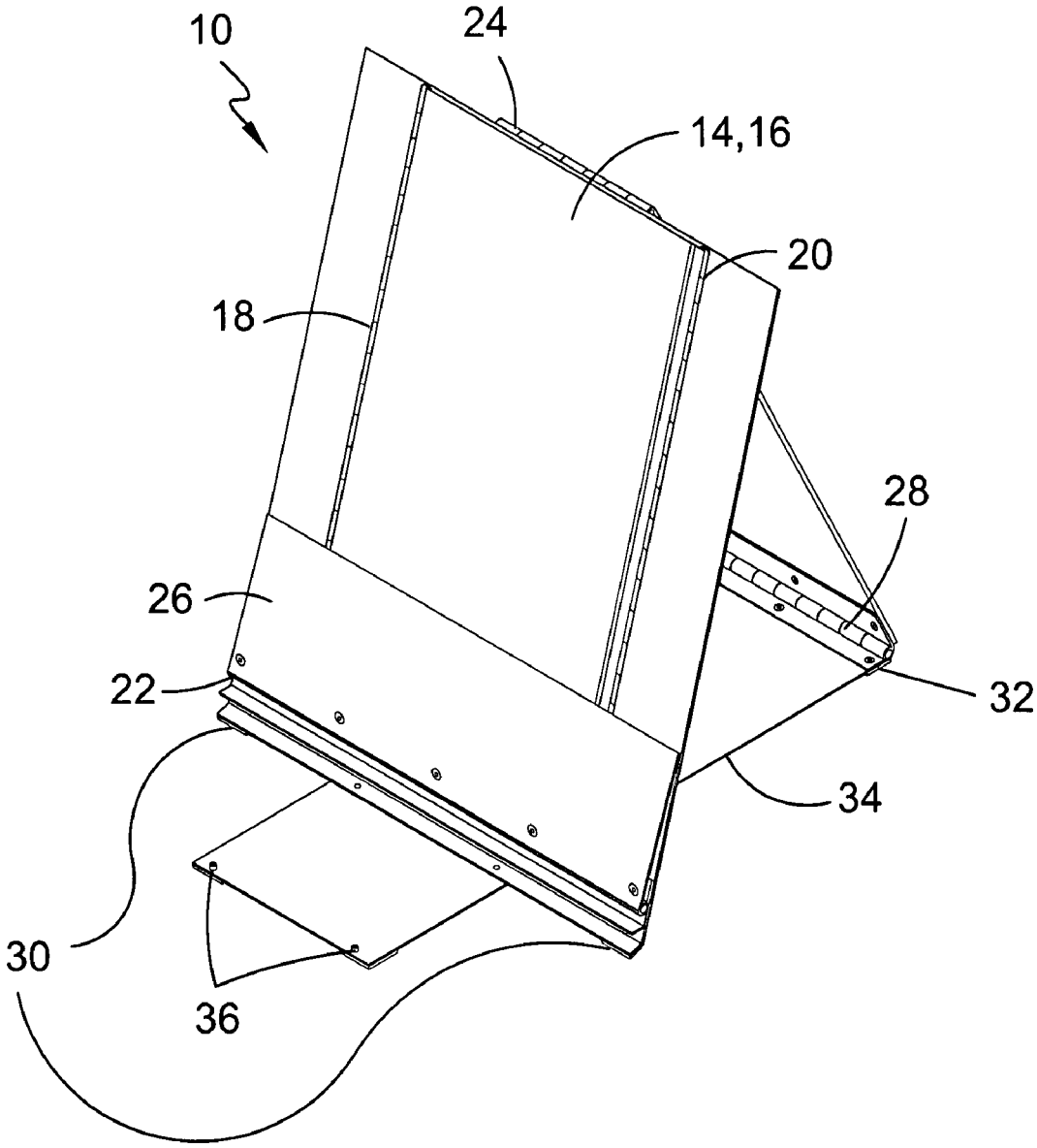
FIG. 6 is a perspective view of the present invention having the pivotal leaf support in a secured, extended forward position.

Turning to FIG. 6, shown therein is a perspective view of the present invention 10 having the front end of the horizontal pivotal leaf support 34 with the rear securing posts 36 in a secured, extended forward position. Shown is the present invention 10 disclosing a collapsible desk top music book stand having hinged parts movable into an erect assembly with a post and hole forming releasable assembly securement. The stand has a front and rear side with the front side having opposing pivotal leafs 14, 16 increasing the article support area. The device 10 is positioned on a desk top at eye level vision and is easily portable. Other previously disclosed items are also shown.

Figure 7:
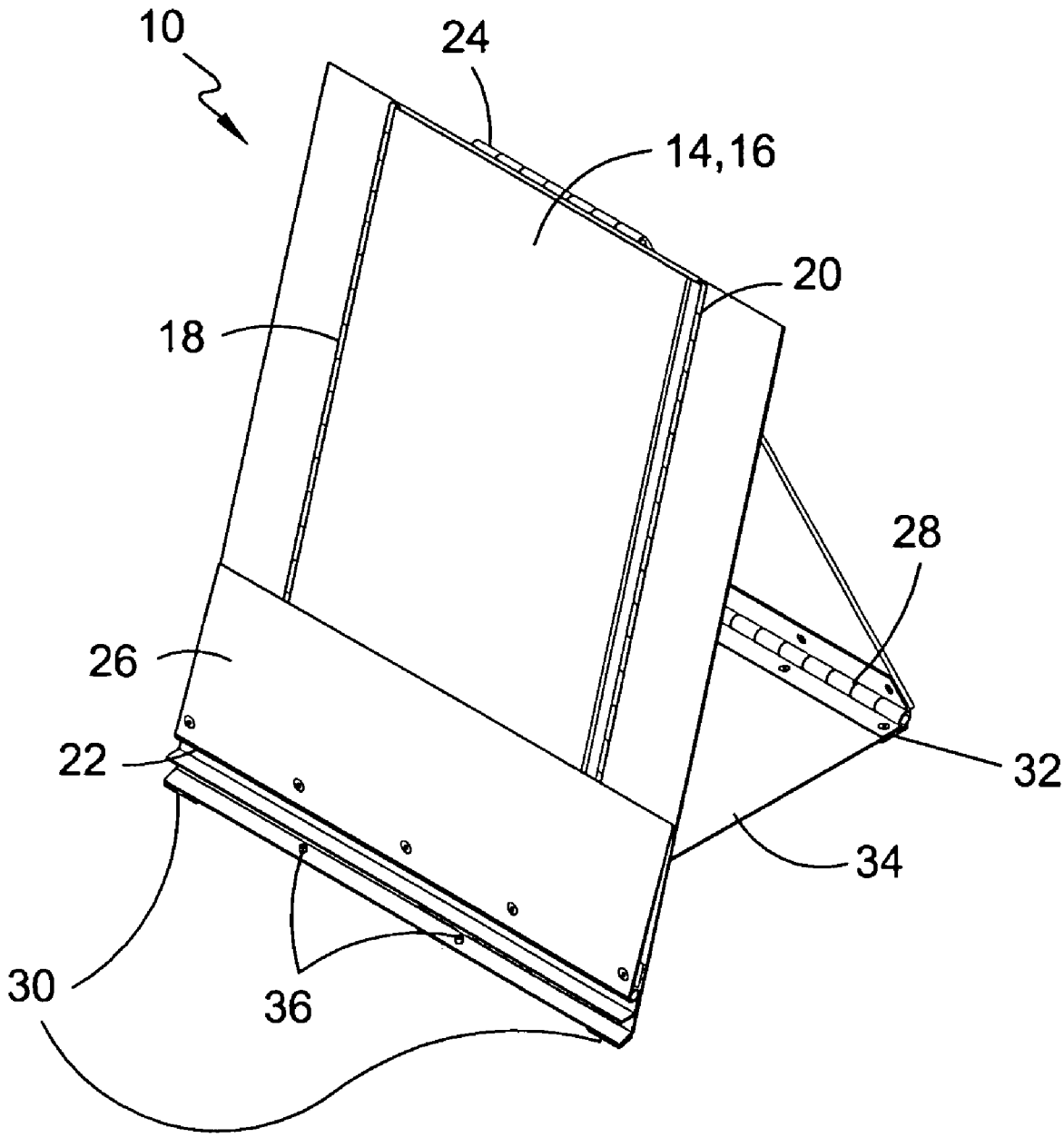
FIG. 7 is a perspective view of the present invention having the pivotal leaf support in a secured position.

Turning to FIG. 7, shown therein is a perspective view of the present invention 10 having the pivotal leaf support 34 with the front securing posts 36 in a secured position. Shown is the present invention 10 disclosing a collapsible desk top music book stand having hinged parts movable into an erect assembly with a post and hole forming releasable assembly securement. The stand has a front and rear side with the front side having opposing pivotal leafs 14, 16 increasing the article support area. The device 10 is positioned on a desk top at eye level vision and is easily portable. Other previously disclosed items are also shown.

Figure 8:
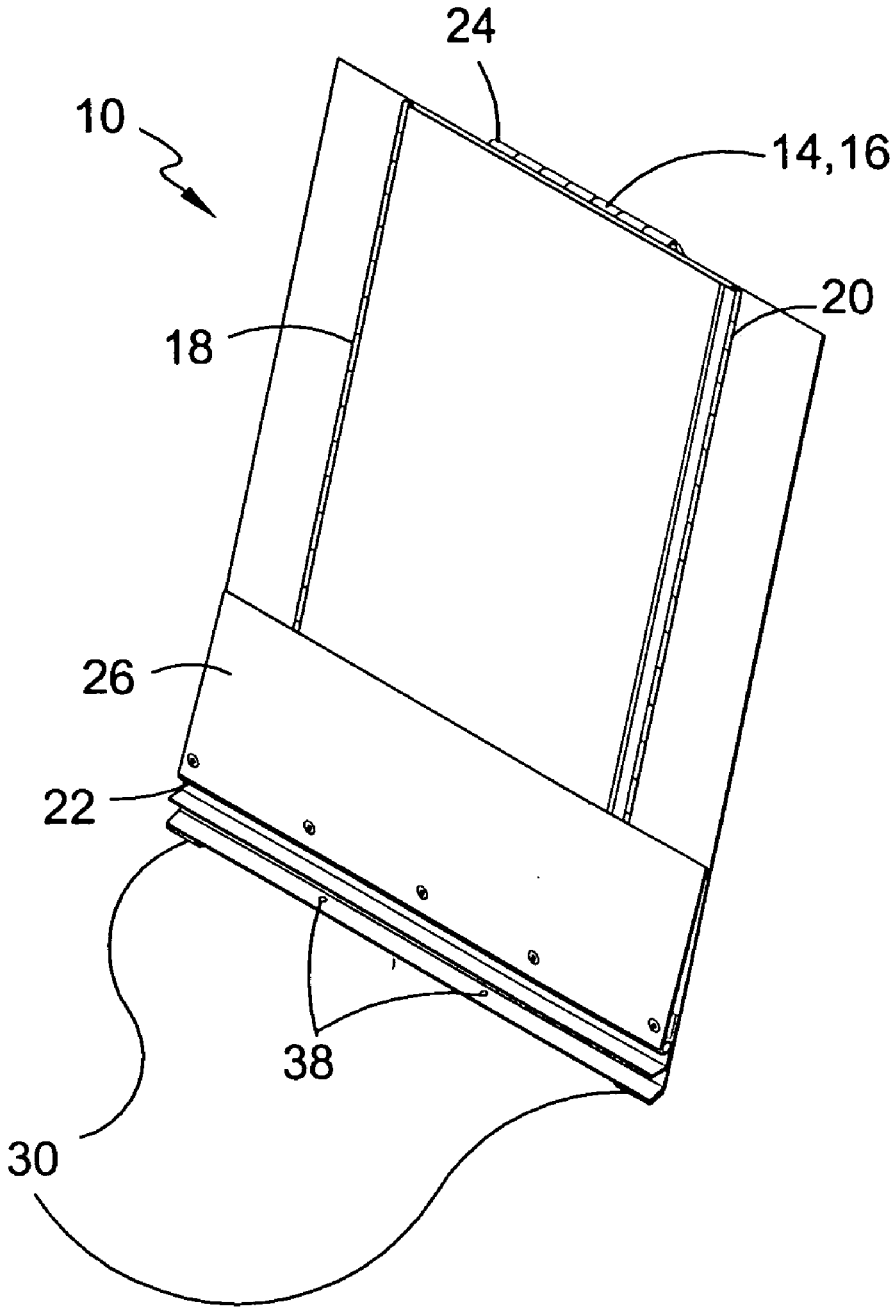
FIG. 8 is a perspective view of the present invention in a folded position.

Turning to FIG. 8, shown therein is a perspective view of the present invention 10 in a folded position. Shown is the present invention 10 disclosing a collapsible desk top music book stand having hinged parts movable into an erect assembly with a post and hole forming releasable assembly securement. The stand has a front and rear side with the front side having opposing pivotal leafs 14, 16 increasing the article support area. The device 10 is positioned on a desk top at eye level vision and is easily portable. Also shown are securing post aperture 38 along with other previously disclosed items.

Figure 9:
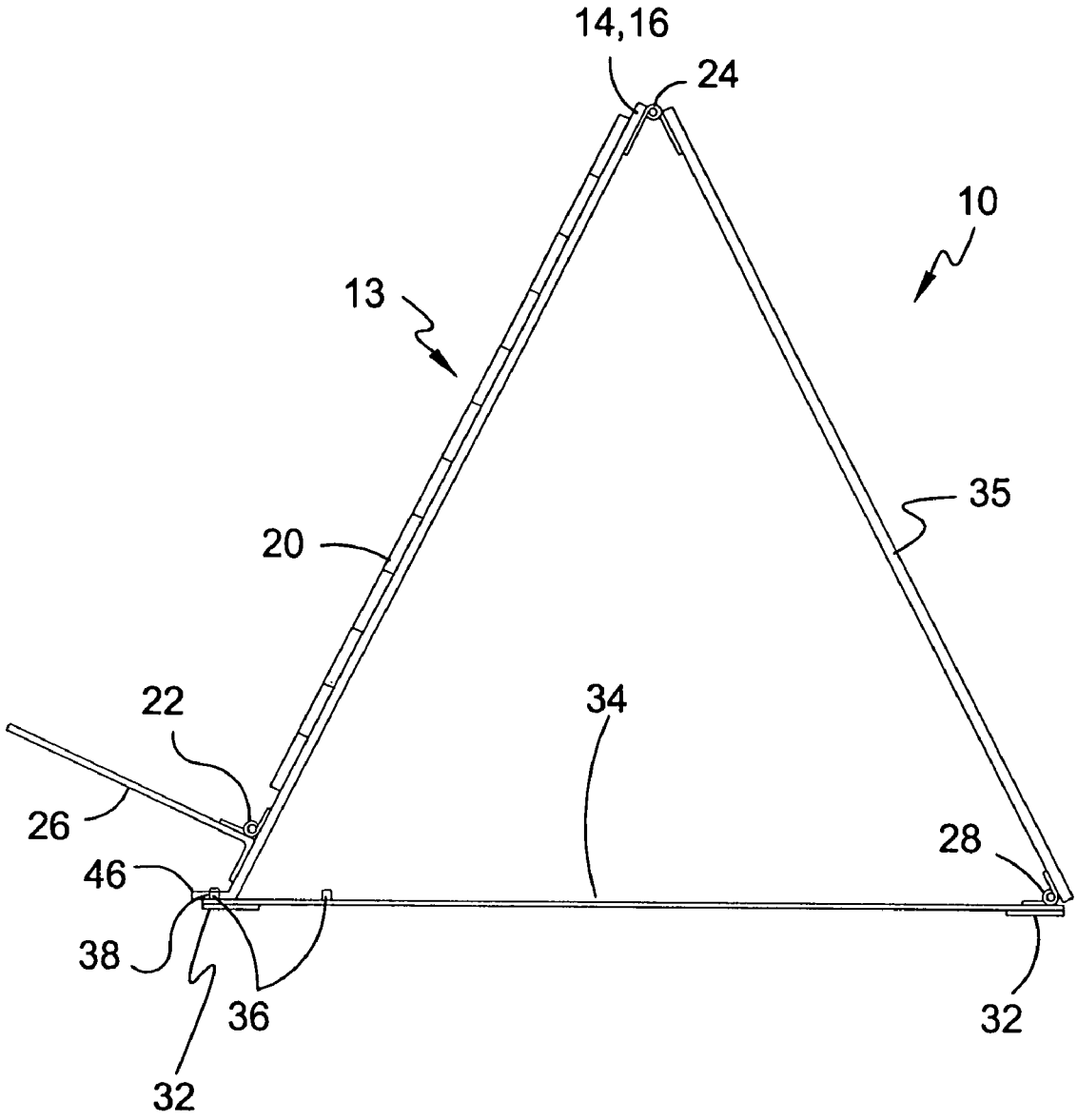
FIG. 9 is a side view of the present invention in an open position.

Turning to FIG. 9, shown therein is a side view of the present invention 10 in an open position. Shown is the present invention 10 disclosing a collapsible desk top music book stand having hinged parts movable into an erect assembly with a front and rear post 36 and hole 38 forming releasable assembly securement. The stand has a planar member 11 which has a front 13 and rear 15 side with the front side having opposing pivotal leafs increasing the article support area. The device 10 is positioned on a desk top at eye level vision and is easily portable. Shown are lower support leafs 34 and rear support leaf 35 along with other previously disclosed items. Also shown are pivotal leaf 26 being about perpendicular to planar member 11 and flange 46 with apertures 38 therein.

Figure 10:
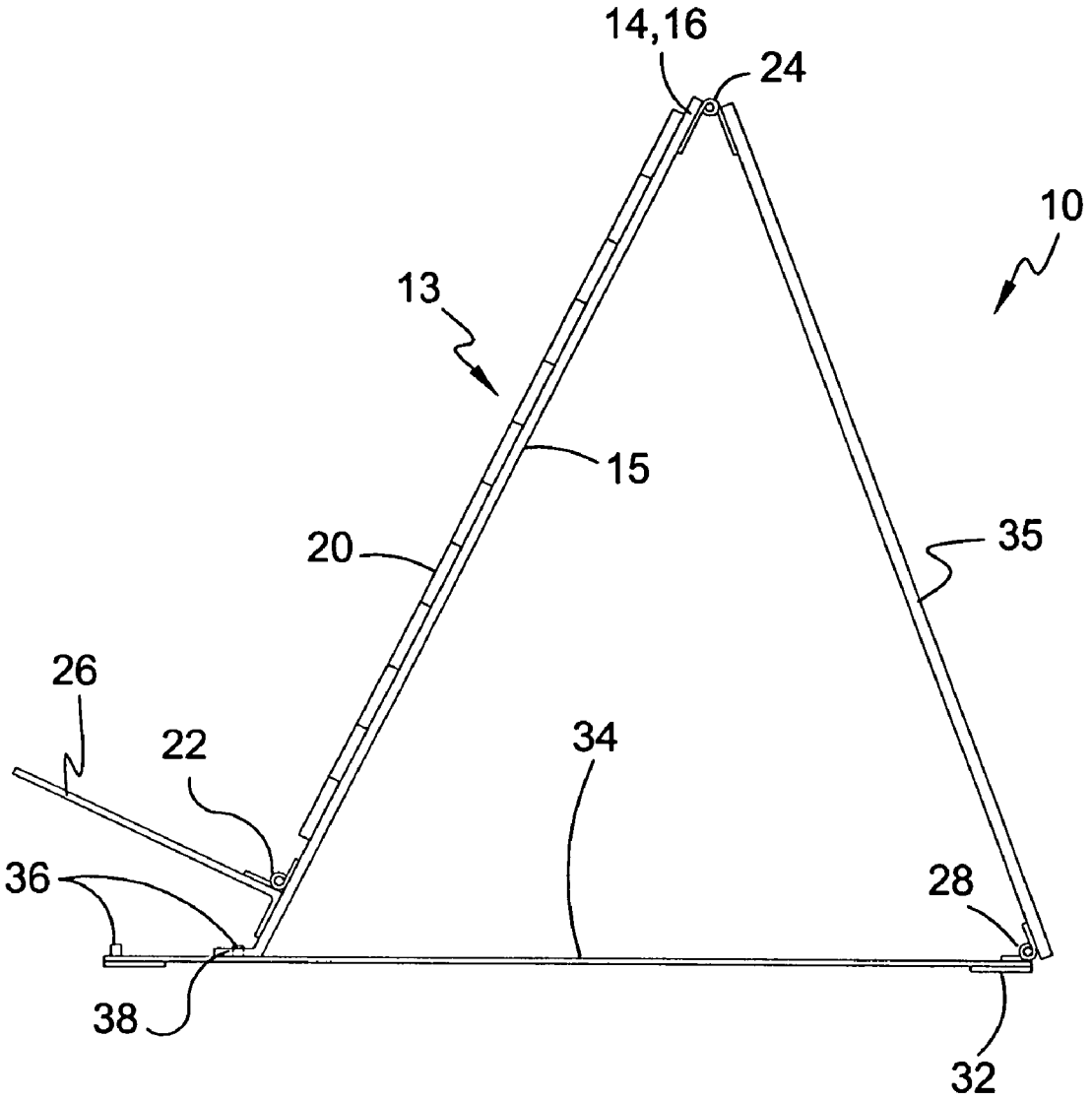
FIG. 10 is a side view of the present invention in an open position and pivotal leaf support extended.

Turning to FIG. 10, shown therein is a side view of the present invention 10 in an open position and front end of pivotal leaf support 34 extended to the front with the rear post 36 in aperture 38. Shown is the present invention 10 disclosing a collapsible desk top music book stand having hinged parts movable into an erect assembly with a rear post 36 and hole 38 forming releasable assembly securement. The stand 10 has a front 13 and rear 15 side with the front side having opposing pivotal leafs 14, 16 increasing the article support area. The device 10 is positioned on a desk top at eye level vision and is easily portable. Other previously disclosed items are also shown along with rear support legs 35.

Figure 11:
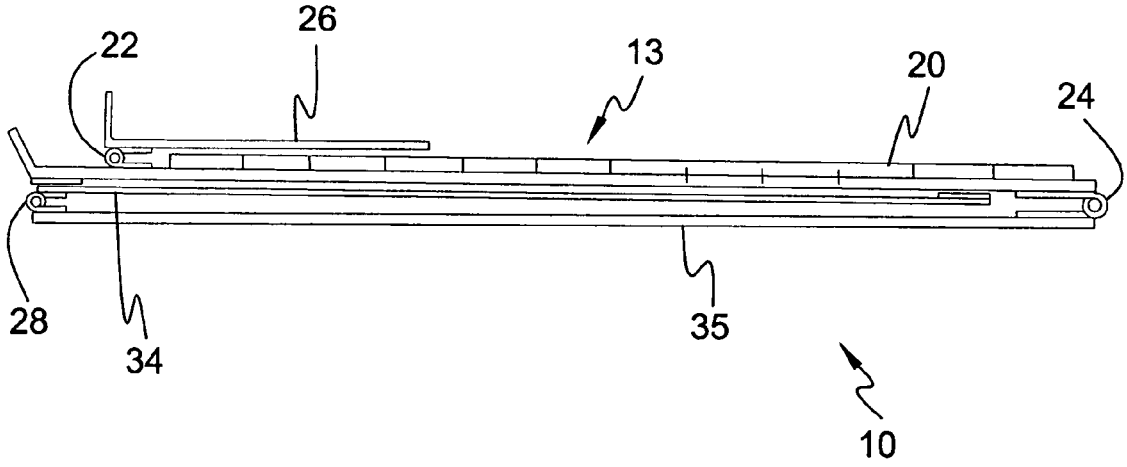
FIG. 11 is a side view of the present invention in a folded position.

Turning to FIG. 11, shown therein is a side view of the present invention 10 in a folded position. Shown is the present invention 10 disclosing a collapsible desk top music book stand having hinged parts movable into an erect assembly with a post and hole forming releasable assembly securement. The stand 10 has a front 13 and rear side with the front side having opposing pivotal leafs increasing the article support area. The device 10 is positioned on a desk top at eye level vision and is easily portable. Shown are hinges 20, 22, 24 and 28, pivotal leaf 26, front surface 13, support leaf 34 and rear support 35. All of the planar members of the present invention may be rectangularly shaped.

Figure 12:
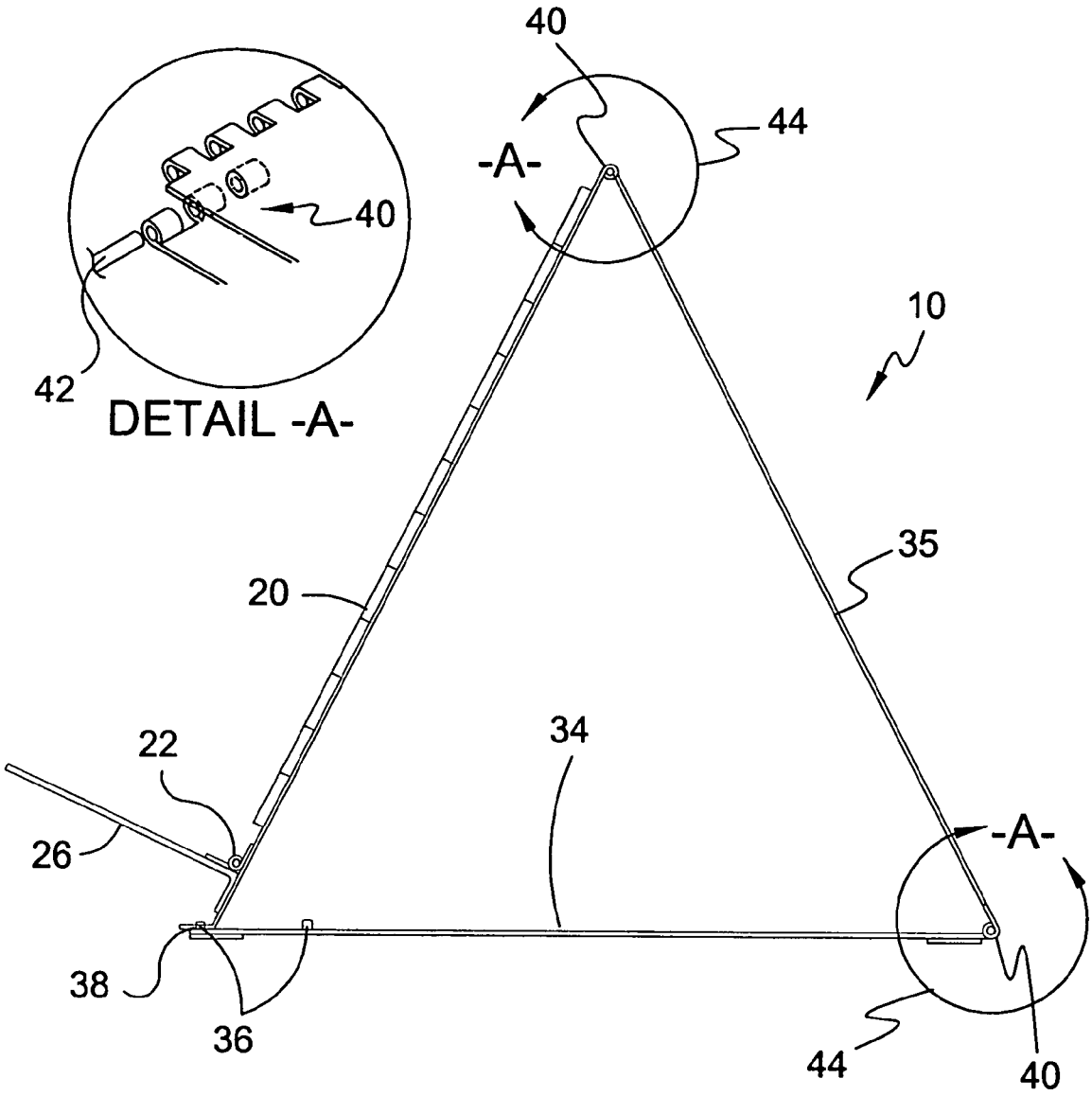
FIG. 12 is a side view of the present invention in an open position.

Turning to FIG. 12, shown therein is a side view of the present invention 10 in an open position. Depicted in FIG. 12 is the collapsible desk top music book stand with integral hinge construction. The integral hinges 40 with hinge pin 42 provide means of improved cost and manufacturability. Preferably sheet aluminum would typically be used in construction to provide rigidity, durability and lightness. Direction arrows 44 are shown along with other previously disclosed items.

I claim:

1. A collapsible book stand, comprising:

a) a first planar member having front and rear surfaces, top and bottom ends, and first, left and second, right sides, wherein a back of a book can rest on said front of said first planar member in a generally upright reading position, a flange being disposed on said bottom end of said first planar member, said flange having at least one aperture therein;

b) a second planar member having top and bottom ends and first, left and second, right sides wherein said top of said second planar member is hingedly connected to said top of said first planar member so that said second planar member forms a generally upright rear support for said first planar member;

c) a third planar member having top and bottom surfaces, front and rear ends and first, left and second, right sides, wherein said rear end of said third planar member is hingedly connected to said bottom end of said second planar member so that said third planar member forms a generally horizontal lower support for said first and second planar members, said third planar member for resting on a support surface, at least one upright securing post being disposed on said top surface of said front end of said third planar member for insertion into said aperture on said flange on said bottom end of said first planar member so that the apparatus can be upright standing on a support surface and support a book thereon;

d) wherein said first, second and third planar members can be folded so as to be contiguous to each other for forming a generally planar apparatus for storage; and e) further comprising a lower pivotal leaf forming a lower support for supporting a bottom edge of a book, said lower pivotal leaf having top and bottom ends, first, left and second, right sides and top and bottom surfaces, wherein said bottom end of said lower pivotal leaf is hingedly connected adjacent to said front, bottom end of said first planar member.

2. The apparatus of claim 1, further comprising fourth and fifth planar members each having front and rear surfaces, top and bottom ends, and first, left and second, right sides, wherein said left side of said fourth planar member is hingedly connected adjacent to said left side of said front of said first planar member so that said fourth planar member can fold from an inward position wherein said rear surface of said fourth planar member is contiguous to said front surface of said first planar member to an outward position wherein said front surface of said fourth planar member is contiguous to said front surface of said first planar member so that said fourth planar member extends said first planar member toward the left side, wherein said right side of said fifth planar member is hingedly connected adjacent to said right side of said front of said first planar member so that said fifth planar member can fold from an inward position wherein said rear surface of said fifth planar member is contiguous to said front surface of said first planar member to an outward position wherein said front surface of said fifth planar member is contiguous to said front surface of said first planar member so that said fifth planar member extends said first planar member toward the right side, wherein said fourth and fifth planar members can each be folded inwardly so as to be contiguous to each other for forming a generally planar apparatus for storage.

3. The apparatus of claim 2, wherein said lower pivotal leaf can fold from and inward position wherein said top surface of said lower pivotal leaf is contiguous to said front surface of said first planar member to an outward position wherein said lower pivotal leaf is generally perpendicular to said first planar member so that a bottom edge of a book can rest on said top surface of said lower pivotal leaf, wherein said lower pivotal leaf can fold inwardly so as to be contiguous to said first planar member for forming a generally planar apparatus for storage.

4. The apparatus of claim 3, wherein there are first and second apertures disposed in a spaced apart relationship on said flange, wherein there are first and second securing posts forming a first pair of securing posts disposed on said top surface of said front end of said third planar member in a manner so as to be insertable into said first and second apertures so that said third planar member is secured to said first planar member.

5. The apparatus of claim 4, wherein there are third and fourth securing posts forming a second pair of securing posts disposed on said top surface of said third planar member between said front and rear ends of said third planar member to the rear of said first pair of securing posts in a manner so as to be insertable into said first and second apertures so that said third planar member is secured to said first planar member.

6. The apparatus of claim 5, further comprising non-slip pads being disposed on the corners of said bottom surface of said third planar member so that the apparatus will be slip-free on a support surface.

7. The apparatus of claim 6, wherein said hinges are bolted onto each of said first, second, third, and fourth planar members and said lower pivotal leaf of the apparatus.

8. The apparatus of claim 7, wherein said hinges are riveted onto each of said first, second, third, and fourth planar members and said lower pivotal leaf of the apparatus.

9. The apparatus of claim 8, wherein said hinges are integrally constructed with each of said first, second, third, and fourth planar members and said lower pivotal leaf of the apparatus.

10. The apparatus of claim 9, wherein said first, second, third, and fourth planar members and said lower pivotal leaf are rectangular shaped.

11. A collapsible stand for supporting a music book, comprising:

a) a first planar member having front and rear surfaces, top and bottom ends, and first, left and second, right sides, wherein a back of a book can rest on said front of said first planar member in a generally upright reading position, a flange being disposed on said bottom end of said first planar member, said flange having at least one aperture therein;

b) a second planar member having top and bottom ends and first, left and second, right sides wherein said top of said second planar member is hingedly connected to said top of said first planar member so that said second planar member forms a generally upright rear support for said first planar member;

c) a third planar member having top and bottom surfaces, front and rear ends and first, left and second, right sides, wherein said rear end of said third planar member is hingedly connected to said bottom end of said second planar member so that said third planar member forms a generally horizontal lower support for said first and second planar members, said third planar member for resting on a support surface, at least one upright securing post being disposed on said top surface of said front end of said third planar member for insertion into said aperture on said flange on said bottom end of said first planar member so that the apparatus can be upright standing on a support surface and support a book thereon;

d) wherein said first, second and third planar members can be folded so as to be contiguous to each other for forming a generally planar apparatus for storage;

e) fourth and fifth planar members each having front and rear surfaces, top and bottom ends, and first, left and second, right sides, wherein said left side of said fourth planar member is hingedly connected adjacent to said left side of said front of said first planar member so that said fourth planar member can fold from an inward position wherein said rear surface of said fourth planar member is contiguous to said front surface of said first planar member to an outward position wherein said front surface of said fourth planar member is contiguous to said front surface of said first planar member so that said fourth planar member extends said first planar member toward the left side, wherein said right side of said fifth planar member is hingedly connected adjacent to said right side of said front of said first planar member so that said fifth planar member can fold from an inward position wherein said rear surface of said fifth planar member is contiguous to said front surface of said first planar member to an outward position wherein said front surface of said fifth planar member is contiguous to said front surface of said first planar member so that said fifth planar member extends said first planar member toward the right side, wherein said fourth and fifth planar members can each be folded inwardly so as to be contiguous to each other for forming a generally planar apparatus for storage; and f) a lower pivotal leaf forming a lower support for supporting a bottom edge of a book, said lower pivotal leaf having top and bottom ends, first, left and second, right sides and top and bottom surfaces, wherein said bottom end of said lower pivotal leaf is hingedly connected adjacent to said front, bottom end of said first planar member so that said lower pivotal leaf can fold from an inward position to an outward position.

* * * * *